US009035541B2

(12) United States Patent
Yoshida et al.

(10) Patent No.: US 9,035,541 B2
(45) Date of Patent: May 19, 2015

(54) SPARK PLUG

(71) Applicant: NGK Spark Plug Co., Ltd., Nagoya, Aichi (JP)

(72) Inventors: Haruki Yoshida, Aichi (JP); Takamitsu Mizuno, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/388,092

(22) PCT Filed: Jan. 11, 2013

(86) PCT No.: PCT/JP2013/000085
§ 371 (c)(1),
(2) Date: Sep. 25, 2014

(87) PCT Pub. No.: WO2013/145502
PCT Pub. Date: Oct. 3, 2013

(65) Prior Publication Data

US 2015/0061485 A1 Mar. 5, 2015

(30) Foreign Application Priority Data

Mar. 28, 2012 (JP) ..... 2012-075044

(51) Int. Cl.
*H01T 13/20* (2006.01)
*H01T 13/04* (2006.01)

(52) U.S. Cl.
CPC ..... *H01T 13/04* (2013.01); *H01T 13/20* (2013.01)

(58) Field of Classification Search
CPC ..... H01T 13/04; H01T 13/20
See application file for complete search history.

(56) References Cited

U.S. PATENT DOCUMENTS

| | | | | |
|---|---|---|---|---|
| 6,373,173 | B1 * | 4/2002 | Suzuki | 313/143 |
| 2001/0002096 | A1 | 5/2001 | Honda et al. | 313/143 |
| 2010/0264823 | A1 | 10/2010 | Suzuki et al. | 315/71 |
| 2012/0169207 | A1 * | 7/2012 | Kato | 313/141 |

FOREIGN PATENT DOCUMENTS

| | | | |
|---|---|---|---|
| JP | 62-8484 | 1/1987 | H01T 13/39 |
| JP | 2001-155839 | 6/2001 | H01T 13/20 |
| JP | 2009-245716 | 10/2009 | H01T 13/20 |
| WO | WO2011/033902 | 3/2011 | H01T 13/20 |

OTHER PUBLICATIONS

International Search Report from corresponding International Patent Application No. PCT/JP2013/000085 (English-language translation provided), dated Apr. 16, 2013.

* cited by examiner

*Primary Examiner* — Donald Raleigh
(74) *Attorney, Agent, or Firm* — Kusner & Jaffe

(57) ABSTRACT

A spark plug includes an insulator having an axial hole, a metal terminal member having an insert portion and a depression formation zone existing on the insert portion and having depressions, and a metallic shell. The spark plug satisfies the following conditions: (1) the insert portion has a length H of 35 mm or more; (2) the depression formation zone has a length F of 13 mm or more; (3) the insert portion has a smooth surface zone on its outer circumferential surface; (4) the ratio (A/B) between diameter A of a forward end of the insert portion and inside diameter B of the insulator measured at the forward end satisfies the relational expression $0.9 \leq A/B \leq 0.98$; and (5) Vickers hardness of the insert portion measured at the center of a cross section of the insert portion is 150 Hv or more to 350 Hv or less.

11 Claims, 3 Drawing Sheets

SPARK PLUG

TECHNICAL FIELD

The present invention relates to a spark plug for providing ignition in an internal combustion engine, and more particularly to a spark plug having a resistor therein.

BACKGROUND ART

A spark plug for providing ignition in an internal combustion engine, such as an automobile engine, generally includes a tubular metallic shell; a tubular insulator disposed in a hole of the metallic shell; a center electrode disposed at the forward side of an axial hole of the insulator; a metal terminal member disposed at the rear side of the axial hole; and a ground electrode whose one end is joined to the forward end of the metallic shell and whose other end faces the center electrode and forms a spark discharge gap in cooperation with the center electrode. Furthermore, in order to prevent generation of radio noise, a known spark plug has a resistor provided in the axial hole between the center electrode and the metal terminal member.

In recent years, high output and high efficiency have been required of internal combustion engines of automobiles, etc.; in this connection, in order to attain free engine design, a reduction in engine size, etc., demand has been rising for development of a small-sized spark plug. In order to reduce the size of a spark plug, reducing the diameter of a hole in the insulator is inevitable. However, in some cases, a conventionally designed spark plug has involved a deterioration in under-load life as a result of the insulator being reduced in size.

In order to cope with such a problem, for example, claim 1 in Patent Document 1 provides "a spark plug characterized in that . . . the electrically conductive glass seal layer has a diameter D of 3.3 mm or less, and a joint surface between the resistor and the electrically conductive glass seal layer is curved." The document describes that the invention "can provide a spark plug whose diameter is reduced and which exhibits excellent vibration resistance and under-load life of the resistor, through enhancement of adhesion between the resistor and the electrically conductive glass seal layer" (refer to Paragraph No. 0012).

PRIOR ART DOCUMENT

Patent Document

Patent Document 1: Japanese Patent Application Laid-Open (kokai) No. 2009-245716

SUMMARY OF THE INVENTION

Problem to be Solved by the Invention

An object of the present invention is to provide a spark plug having excellent under-load life.

Means for Solving the Problem

In a spark plug having a resistor disposed between a center electrode and a metal terminal member, the resistor is formed of, for example, a mixture of nonmetal powder, such as glass powder or carbon black, and metal powder. In the case of a low content of metal powder, adhesion between the resistor and the center electrode made of metal and between the resistor and the metal terminal member deteriorates. Therefore, in some cases, a seal layer having a relatively high content of metal powder is disposed between the resistor and the center electrode and between the resistor and the metal terminal member.

In a spark plug having the resistor and, if needed, the seal layers, the center electrode, the insulator, and the metal terminal member are attached in the following manner. First, the center electrode is inserted into the axial hole of the insulator. Subsequently, a resistor composition used to form the resistor, and seal powder used to form the seal layer are charged into the axial hole. Then, the metal terminal member is inserted into the axial hole. While heat is applied to the resistor composition and the seal powder, the metal terminal member is pressed. By this procedure, the resistor composition and the seal powder are compressed to become the resistor and the seal layers which are fixed together in a sealed condition.

The thus-assembled spark plug may suffer a deterioration in under-load life as a result of, for example, an increase in resistance of the resistor and a deterioration in adhesion between the seal layers, the resistor, the center electrode, and the metal terminal member.

Under the circumstances, the inventors of the present invention have conceived the following: in pressing the metal terminal member into the axial hole, by means of the metal terminal member effectively transmitting a pressing force to the resistor composition, an increase in resistance of the resistor can be restrained.

The present invention provides, as means for solving the problem, <1> a spark plug comprising an insulator having an axial hole extending along an axial line, a metal terminal member having an insert portion accommodated in the axial hole and a depression formation zone existing on an outer circumferential surface of the insert portion and having a plurality of depressions, and a metallic shell accommodating a forward portion of the insulator therein to thereby hold the insulator, and characterized by satisfying the following conditions (1) to (5):

(1) the insert portion has a length H of 35 mm or more along the axial line;

(2) the depression formation zone has a length F of 13 mm or more along the axial line;

(3) the insert portion has a smooth surface zone on its outer circumferential surface;

(4) a ratio (A/B) between diameter A of a forward end of the insert portion and inside diameter B of the insulator measured at the forward end satisfies a relational expression $0.9 \leq A/B \leq 0.98$; and (5) the insert portion has a Vickers hardness of 150 Hv or more to 350 Hv or less as measured at the center of a cross section of the insert portion cut along a direction orthogonal to the axial line.

Preferred modes of the spark plug are as follows.

<2> In the spark plug mentioned above in <1>, the insulator has a first inner circumferential surface having the inside diameter B, a second inner circumferential surface having a diameter greater than the inside diameter B and disposed rearward of the first inner circumferential surface and the metallic shell, and a stepped portion connecting the first inner circumferential surface and the second inner circumferential surface, and at least a portion of the depression formation zone is disposed in a space surrounded by the stepped portion.

<3> In the spark plug mentioned above in <1> or <2>, at least a portion of the smooth surface zone is disposed in a space surrounded by the second inner circumferential surface.

<4> In the spark plug mentioned above in any one of <1> to <3>, the depressions in the depression formation zone have a depth D of 0.07 mm or more.

<5> In the spark plug mentioned above in any one of <1> to <4>, the inside diameter B is 3.5 mm or less.

<6> In the spark plug mentioned above in any one of <2> to <5>, a difference (J−K) between diameter K of a portion of the insert portion surrounded by the second inner circumferential surface and inside diameter J of the second inner circumferential surface measured across the portion has a maximum value $(J-K)_{max}$ of 0.05 mm to 0.25 mm.

<7> In the spark plug mentioned above in any one of <1> to <6>, the smooth surface zone has a length (H−F) of 8 mm or more along the axial line.

<8> In the spark plug mentioned above in any one of <1> to <7>, the ratio (A/B) satisfies a relational expression $0.93 \leq A/B$.

<9> In the spark plug mentioned above in any one of <1> to <8>, the inside diameter B is 2.9 mm or less.

<10> In the spark plug mentioned above in any one of <1> to <9>, the Vickers hardness is 200 Hv or more to 320 Hv or less.

<11> In the spark plug mentioned above in any one of <2> to <10>, a connection for electrically connecting the metal terminal member and the center electrode is disposed in the axial hole between the metal terminal member and the center electrode, and the connection exists only in a space surrounded by the first inner circumferential surface.

Effects of the Invention

The spark plug of the present invention is such that the insert portion has a length H of 35 mm or more along the axial line. Thus, in the process of manufacturing the spark plug, when the metal terminal member is pressed into the axial hole of the insulator, the insert portion is more likely to bend as compared with a short insert portion and thus encounters difficulty in effectively transmitting a pressing force to a resistor composition charged in the axial hole. However, since the insert portion in the spark plug of the present invention satisfies the above-mentioned conditions (2) to (5), when the insert portion is pressed into the axial hole, the insert portion can sufficiently transmit a pressing force to the resistor composition, so that a resistor having high density can be formed. Accordingly, the spark plug can have excellent under-load life.

Next will be further described in detail the effects yielded by the insert portion's satisfying the above-mentioned conditions (2) to (5). The insert portion in the present invention has a Vickers hardness of 150 Hv or more to 350 Hv or less, preferably 200 Hv or more to 320 Hv or less. Thus, when the insert portion is pressed into the axial hole, through the synergistic effect of the remaining conditions, the insert portion can sufficiently transmit a pressing force to the resistor composition.

Also, the insert portion in the present invention has, on its outer circumferential surface, the depression formation zone having a plurality of depressions, and the depression formation zone has a length F of 13 mm or more along the axial line. Thus, by virtue of work hardening, the insert portion is improved in strength at a portion having the depression formation zone. Accordingly, the insert portion becomes unlikely to bend and thus can sufficiently transmit a pressing force to the resistor composition. Through employment of a Vickers hardness of the metal terminal member in excess of 320 Hv, the insert portion also becomes unlikely to bend. However, employment of excessively high hardness causes a deterioration in workability and a reduction in life of jigs, resulting in an increase in working cost. However, through provision of the depression formation zone on the outer circumferential surface of the insert portion, the insert portion becomes unlikely to bend without involvement of such a problem.

Also, the insert portion has, on its outer circumferential surface, not only the depression formation zone but also the smooth surface zone, and preferably, the smooth surface zone has a length of 8 mm or more along the axial line. Thus, in the insert portion, a portion having the smooth surface zone is lower in strength than a portion having the depression formation zone. Thus, the insert portion becomes likely to appropriately bend at the portion having the smooth surface zone. When the insert portion is pressed into the axial hole, appropriate bending of the insert portion allows further application of a pressing force to the resistor composition without involvement of terminal floating. As a result, a resistor having high density can be formed. Terminal floating means a condition in which the axial length of that portion of the metal terminal member which protrudes from the axial hole is longer than a predetermined length.

Also, the ratio (A/B) between the diameter A of a forward end of the insert portion and the inside diameter B of the insulator measured at the forward end satisfies the relational expression $0.9 \leq A/B \leq 0.98$, preferably $0.93 \leq A/B \leq 0.98$. Thus, an appropriate clearance is provided between the insert portion and the inner wall surface of the insulator. Accordingly, when the insert portion is pressed into the axial hole, the insert portion can effectively transmit a pressing force to the resistor composition.

As described above, the spark plug which satisfies the above-mentioned conditions (1) to (5) has excellent under-load life for the following reason: when the insert portion is pressed into the axial hole, the insert portion can effectively transmit a pressing force to the resistor composition, whereby a resistor having high density can be formed.

In the case where the spark plug of the present invention is such that the insulator has the stepped portion in its axial hole, at least a portion of the depression formation zone is disposed in a space surrounded by the stepped portion. Thus, when the insert portion is pressed into the axial hole, bending of the insert portion at the stepped portion can be prevented. Therefore, there can be prevented a failure to sufficiently transmit a pressing force to the resistor composition, which could otherwise result from the insert portion being caught by the stepped portion. As a result, the present invention can provide a spark plug having excellent under-load life.

The spark plug of the present invention is such that at least a portion of the smooth surface zone is disposed in a space surrounded by the second inner circumferential surface; i.e., such that at least a portion of the smooth surface zone exists on a rear portion of the insert portion. Thus, for example, in the case where the axial hole has a stepped portion, when the insert portion is pressed into the axial hole, the following problem can be prevented: the insert portion bends at the stepped portion and is thus caught by the stepped portion. Also, after the insert portion is pressed into the axial hole and sufficiently transmits a pressing force to the resistor composition, a rear portion of the insert portion bends appropriately, so that the insert portion can further apply a pressing force to the resistor composition without involvement of terminal floating. As a result, a resistor having high density can be formed, whereby a spark plug having excellent under-load life can be provided.

The spark plug of the present invention is such that a depression in the depression formation zone has a depth D of 0.07 mm or more. Thus, the effect of work hardening is more likely to be exhibited. Thus, the insert portion is improved in strength at a portion where the depression formation zone exists. Accordingly, the insert portion becomes unlikely to bend, so that the insert portion can sufficiently transmit a pressing force to the resistor composition. As a result, the present invention can provide a spark plug having excellent under-load life.

The spark plug of the present invention is such that the inside diameter B is 3.5 mm or less, particularly 2.9 mm or less. Thus, under-load life is further improved.

The spark plug of the present invention is such that the difference (J−K) between the diameter K of a portion of the insert portion surrounded by the second inner circumferential surface and the inside diameter J of the second inner circumferential surface measured across the portion has a maximum value $(J-K)_{max}$ of 0.05 mm to 0.25 mm. Thus, when the insert portion is pressed into the axial hole, the insert portion becomes likely to appropriately bend at its portion surrounded by the second inner circumferential surface. Thus, after the insert portion is pressed into the axial hole and sufficiently transmits a pressing force to the resistor composition, the insert portion bends appropriately at its portion surrounded by the second inner circumferential surface, so that the insert portion can further apply a pressing force to the resistor composition without involvement of terminal floating. As a result, a resistor having high density can be formed, whereby a spark plug having excellent under-load life can be provided.

The spark plug of the present invention is such that the connection exists only in a space surrounded by the first inner circumferential surface. This feature restrains use of a pressing force, which the metal terminal member applies to connection powder used to form the connection, to move the connection powder into a clearance between the metal terminal member and the inner wall surface of the insulator, so that a pressing force is effectively used for pressing the connection powder. Accordingly, a resistor having high density is formed. Therefore, the present invention can provide a spark plug having excellent under-load life.

MODES FOR CARRYING OUT THE INVENTION

Figure 1:
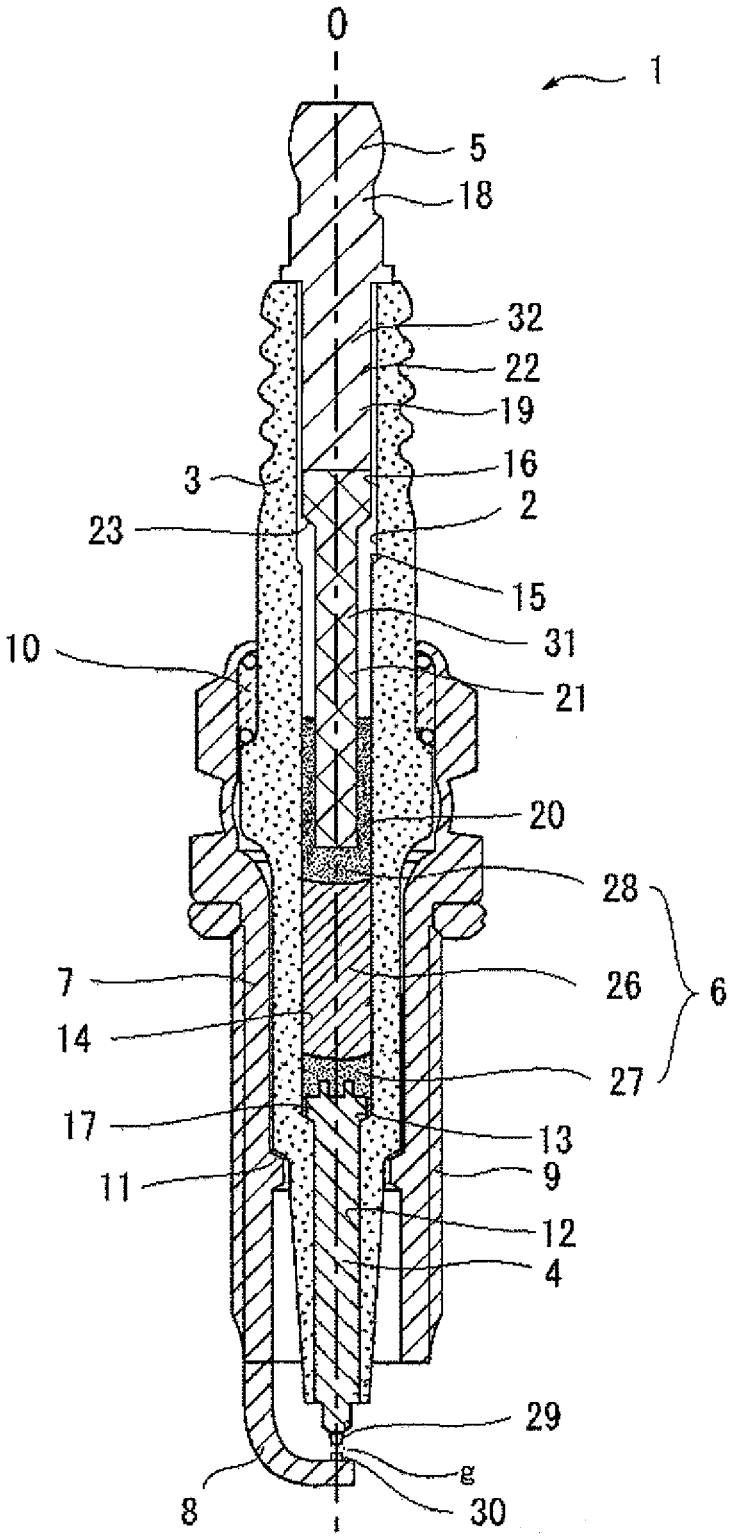
FIG. 1 is a sectional overall explanatory view of a spark plug according to an embodiment of the present invention.

FIG. 1 shows a spark plug according to an embodiment of the present invention. FIG. 1 is a sectional overall explanatory view of a spark plug 1 according to the embodiment of the present invention. The axial line of an insulator is represented by O. In the following description, the downward direction in FIG. 1 is referred to as the forward direction of the axial line O, and the upward direction as the rearward direction of the axial line O.

The spark plug 1 includes an insulator 3 having an axial hole 2 extending along the axial line O; a center electrode 4 held in a forward end portion of the axial hole 2; a metal terminal member 5 held in a rear portion of the axial hole 2; a connection 6 electrically connecting the center electrode 4 and the metal terminal member 5 in the axial hole 2; a metallic shell 7 accommodating the insulator 3 therein; and a ground electrode 8 whose one end is joined to the forward end surface of the metallic shell 7 and whose other end faces the center electrode 4 with a gap formed therebetween.

The metallic shell 7 has a substantially cylindrical shape and accommodates and holds the insulator 3 therein. The metallic shell 7 has a threaded portion 9 formed on the outer circumferential surface of its forward portion. Through utilization of the threaded portion 9, the spark plug 1 is attached to the cylinder head of an unillustrated internal combustion engine. The metallic shell 7 can be formed of an electrically conductive steel material; for example, low-carbon steel. In order to reduce spark plug size, preferably, the threaded portion 9 has a thread size of M12 or less.

The insulator 3 is held in an inner circumferential portion of the metallic shell 7 through a talc 10, a packing 11, etc. The insulator 3 has a first inner circumferential surface 14 which surrounds a forward portion of an insert portion 19; a second inner circumferential surface 16 disposed rearward of the first inner circumferential surface 14 and the metallic shell 7 and having a diameter greater than the inside diameter of the first inner circumferential surface 14; and a third inner circumferential surface 12 disposed forward of the first inner circumferential surface 14 and having a diameter smaller than the inside diameter of the first inner circumferential surface 14. The first inner circumferential surface 14 and the second inner circumferential surface 16 are connected through a stepped portion 15. The first inner circumferential surface 14 and the third inner circumferential surface 12 are connected through a second stepped portion 13. The insulator 3 is fixed to the metallic shell 7 while its forward end portion protrudes from the forward end surface of the metallic shell 7. Desirably, the insulator 3 is formed of a material having mechanical strength, thermal strength, electrical strength, etc. Examples of such a material include a ceramic sintered body which predominantly contains alumina.

The center electrode 4 is held by and electrically insulated from the metallic shell 7 in the following condition: the center electrode 4 is surrounded by the third inner circumferential surface 12 of the insulator 3; a large-diameter flange portion 17 provided at the rear end of the center electrode 4 is seated on the second stepped portion 13; and the forward end of the center electrode 4 protrudes from the forward end surface of the insulator 3. Desirably, the center electrode 4 is formed of a material having thermal conductivity, mechanical strength, etc. Examples of such a material include a Ni-based alloy such as INCONEL (trade name). An axial core portion of the center electrode 4 may be formed of a metal material having excellent thermal conductivity, such as Cu or Ag.

The ground electrode 8 assumes the form of, for example, a substantially rectangular columnar body. The shape and structure of the ground electrode 8 are designed as follows: one end of the ground electrode 8 is joined to the forward end surface of the metallic shell 7, and the body of the ground electrode 8 is bent at an intermediate position so as to assume a shape resembling the letter L and such that a distal end portion of the ground electrode 8 faces a forward end portion of the center electrode 4 with a gap formed therebetween. The ground electrode 8 is formed of a material similar to that used to form the center electrode 4.

Noble metal tips 29 and 30 formed of a platinum alloy, an iridium alloy, or the like may be provided on the opposed surfaces of the center electrode 4 and the ground electrode 8, respectively. Alternatively, the noble metal tip may be provided on only either one of the center electrode 4 and the ground electrode 8. In the spark plug 1 of the present embodiment, the noble metal tips 29 and 30 are provided on the center electrode 4 and the ground electrode 8, respectively. A spark discharge gap g is formed between the noble metal tips 29 and 30.

The metal terminal member 5 is adapted to apply, to the center electrode 4, voltage from an external source for performing spark discharge between the center electrode 4 and the ground electrode 8. The metal terminal member 5 has a terminal portion 18 and an insert portion 19. The terminal portion 18 has an outside diameter greater than the inside diameter of the axial hole 2 and protrudes from the axial hole 2 and is in contact with the rear end surface of the insulator 3. The insert portion 19 extends forward along the axial line O from the forward end surface of the terminal portion 18 and is accommodated in the axial hole 2. The metal terminal member 5 is formed of, for example, low-carbon steel and has a Ni metal layer formed on its surface by plating or the like.

The insert portion 19 in the present embodiment has a slender trunk portion 21 located on the forward side along the axial line O and a trunk portion 22 which is located on the rear side along the axial line O and is adjacent to the terminal portion 18 and whose diameter is greater than that of the slender trunk portion 21. The slender trunk portion 21 and the trunk portion 22 are connected through a first stepped portion 23. The slender trunk portion 21 is surrounded at its forward side by the first inner circumferential surface 14 and at its rear side by the second inner circumferential surface 16. The trunk portion 22 is surrounded by the second inner circumferential surface 16.

In the spark plug 1 of the present embodiment, the insert portion 19 is shaped such that two circular columns having different outside diameters are joined together. However, the insert portion 19 may be a circular column having a fixed outside diameter from its forward end to the boundary between the same and the terminal portion 18. Alternatively, the insert portion 19 may be shaped such that three or more circular columns having different outside diameters are joined together.

The connection 6 is disposed in the axial hole 2 between the center electrode 4 and the metal terminal member 5 and electrically connects the center electrode 4 and the metal terminal member 5. The connection 6 has a resistor 26, and the resistor 26 prevents generation of radio noise. In the present embodiment, the connection 6 has a first seal layer 27 between the resistor 26 and the center electrode 4, and a second seal layer 28 between the resistor 26 and the metal terminal member 5. The first seal layer 27 fixes the insulator 3 and the center electrode 4 together in a sealed condition, and the second seal layer 28 fixes the insulator 3 and the metal terminal member 5 together in a sealed condition.

The resistor 26 can be formed of a resistor material. The resistor material is formed by sintering a resistor composition which contains glass powder of soda borosilicate glass or the like, ceramic powder of $ZrO_2$ or the like, electrically-conductive nonmetal powder of carbon black or the like, and/or metal powder of Zn, Sb, Sn, Ag, Ni, or the like. The resistor 5 usually has a resistance of 100Ω or more.

The first seal layer 27 and the second seal layer 28 can be formed of a seal material. The seal material is formed by sintering seal powder which contains glass powder of soda borosilicate glass or the like, and metal powder of Cu, Fe, or the like. The first seal layer 27 and the second seal layer 28 usually have a resistance of several hundreds mΩ or less.

The connection 6 may be composed of only the resistor 26 without employment of the first seal layer 27 and the second seal layer 28 or may be composed of the resistor 26 and either the first seal layer 27 or the second seal layer 28.

In the spark plug 1 of the present embodiment, the resistor 26, the first seal layer 27, and the second seal layer 28 are disposed in the axial hole 2 between the center electrode 4 and the metal terminal member 5; the first seal layer 27 is also provided in a clearance between the center electrode 4 and the first inner circumferential surface 14; and the second seal layer 28 is also provided in a clearance between the metal terminal member 5 and the first inner circumferential surface 14. The second seal layer 28 may be provided not only in the clearance between the metal terminal member 5 and the first inner circumferential surface 14 but also in a clearance between the metal terminal member 5 and the stepped portion 15 and furthermore in a clearance between the metal terminal member 5 and the second inner circumferential surface 16.

In the following description, the resistor material and/or the seal material which constitutes the connection 6 may be collectively referred to as the connection member, and the resistor composition and/or the seal powder used to form the connection 6 may be collectively referred to as the connection powder.

Figure 2:
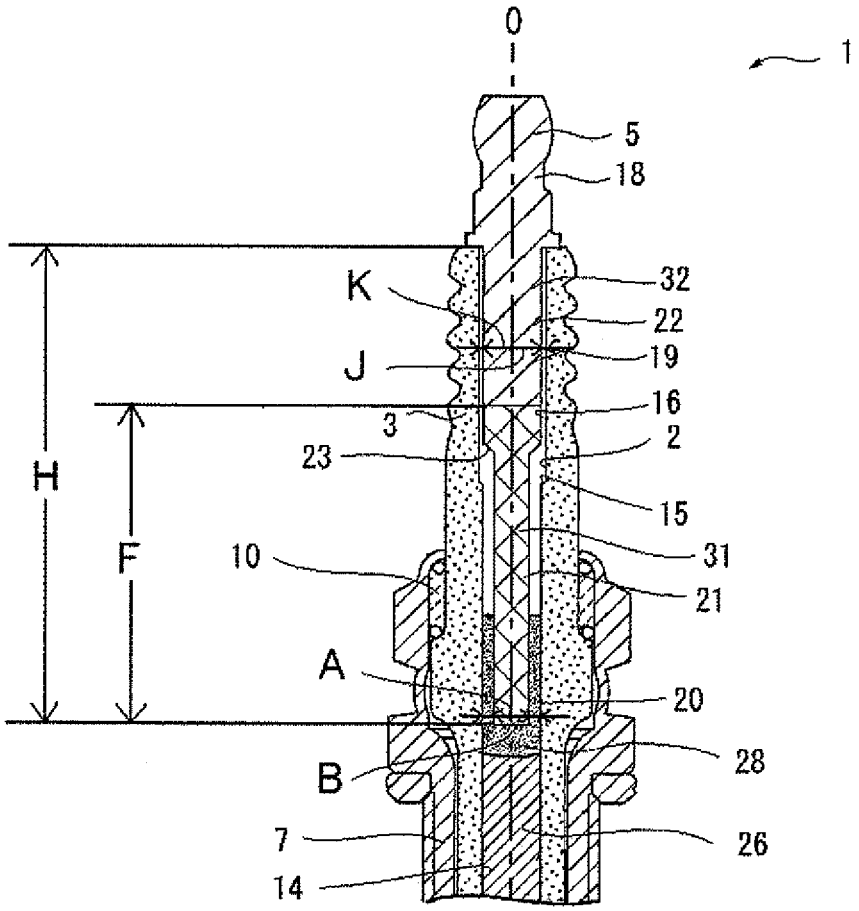
FIG. 2 is a sectional explanatory view of essential portions of the spark plug according to the embodiment of the present invention.

The spark plug of the present invention includes the metal terminal member 5 whose insert portion 19 has the depression formation zone 31 existing on its outer circumferential surface and having a plurality of depressions as shown in FIG. 2, and satisfies the following conditions (1) to (5):

(1) the insert portion 19 has a length H of 35 mm or more along the axial line O;

(2) the depression formation zone 31 has a length F of 13 mm or more along the axial line O;

(3) the insert portion 19 has a smooth surface zone 32 on its outer circumferential surface;

(4) the ratio (A/B) between diameter A of a forward end 20 of the insert portion 19 and inside diameter B of the insulator 3 measured at the forward end 20 satisfies the relational expression $0.9 \leq A/B \leq 0.98$; and (5) the insert portion 19 has a Vickers hardness of 150 Hv or more to 350 Hv or less as measured at the center of a cross section of the insert portion 19 cut along a direction orthogonal to the axial line O.

Condition 1: When the metal terminal member 5 is pressed into the axial hole 2 of the insulator 3 (i.e., in a pressing step, which will be described later), the longer the length H along the axial line O, the more likely the bending of the insert portion 19 toward a direction orthogonal to the axial line O. Accordingly, the insert portion 19 encounters difficulty in effectively transmitting a pressing force to a resistor composition used to form the resistor 26. When the insert portion 19 fails to sufficiently transmit a pressing force to the resistor composition, the resistor 26 having high density cannot be formed; as a result, electrical conductivity becomes poor, so that under-load life is apt to deteriorate. Therefore, maintaining good under-load life is difficult for the spark plug whose insert portion 19 has a length H of 35 mm or more along the axial line O. However, the insert portion 19 in the spark plug 1 satisfies the above-mentioned conditions (2) to (5). Thus, even though the insert portion 19 has a length H of 35 mm or more along the axial line O, as will be described later, when the insert portion 19 is pressed into the axial hole 2, the insert portion 19 can sufficiently transmit a pressing force to the resistor composition, so that the resistor 26 having high density can be formed. As a result, a spark plug having excellent under-load life can be provided.

Condition (5): The insert portion 19 has a Vickers hardness of 150 Hv or more to 350 Hv or less, preferably 200 Hv or more to 320 Hv or less. Thus, when the insert portion 19 is pressed into the axial hole 2, through the synergistic effect of the remaining conditions, the insert portion 19 can sufficiently transmit a pressing force to the resistor composition. When the Vickers hardness of the insert portion 19 is less than 150 Hv, the insert portion 19 is apt to bend toward a direction orthogonal to the axial line O. Accordingly, the insert portion 19 encounters difficulty in effectively transmitting a pressing force to the resistor composition. As a result, the resistor 26 having high density cannot be formed, resulting in a deterioration in under-load life. When the Vickers hardness of the insert portion 19 exceeds 350 Hv, workability deteriorates, and the life of jigs is shortened, so that working cost increases. Also, when the insert portion 19 is pressed into the axial hole 2, the insert portion 19 hardly bends. Thus, in the case of variations in the amount of connection powder charged into the axial hole 2, the variations cannot be absorbed through bending of the insert portion 19. Accordingly, difficulty is encountered in reliably accommodating the insert portion 19 in the axial hole 2. Therefore, after the pressing step, which will be described later, the terminal portion 18 may not come into contact with the rear end surface of the insulator 3; i.e., the terminal portion 18 may fall in a floating condition. On the contrary, when the amount of connection powder is reduced so as to avoid the floating condition of the terminal portion 18, even though the terminal portion 18 is in contact with the rear end surface of the insulator 3, a pressing force may not be sufficiently applied to the resistor composition. As a result, under-load life may deteriorate. Also, when the Vickers hardness of the insert portion 19 is excessively high, in the pressing step, the insulator 3 may be broken.

The Vickers hardness of the insert portion 19 is obtained as follows. The insert portion 19 is cut at a portion having the smooth surface zone 32 in a direction orthogonal to the axial line O. The resultant cut surface is polished. According to a small Vickers hardness test method specified in JIS Z 2244, a regular quadrangular pyramid indenter having an angle $\alpha$ of 136° between the opposite faces at vertex is pressed at a load of 490 mN against the polished surface at five points in the vicinity of the center of the polished surface. The average of the five measured values is taken as the Vickers hardness of the insert portion 19. The Vickers hardness of the insert portion 19 at room temperature can be adjusted by selecting a material used to form the metal terminal member and by changing heat treatment conditions.

Condition (2): The insert portion 19 has, on its outer circumferential surface, the depression formation zone 31 having a plurality of depressions. The depression formation zone 31 is formed by working on an outer circumferential surface of a rod to be formed into the insert portion 19. Such working on the rod of, for example, low-carbon steel improves strength of the outer circumferential surface of the insert portion 19 by virtue of work hardening. Thus, when the insert portion 19 is pressed into the axial hole 2, that portion of the insert portion 19 which has the depression formation zone 31 becomes unlikely to bend toward a direction orthogonal to the axial line O. The Vickers hardness of the entire metal terminal member 5 can be increased by changing heat treatment conditions for material used to form the metal terminal member 5, whereby the metal terminal member 5 becomes unlikely to bend. However, if the Vickers hardness is increased excessively, as mentioned above, workability deteriorates, and working cost increases. By contrast, a deterioration in workability and an increase in working cost are not involved in the method in which the strength of an outer circumferential surface of the insert portion 19 is improved by means of work hardening, whereby the insert portion 19 becomes unlikely to bend when pressed into the axial hole 2.

When the length F of the depression formation zone 31 along the axial line O is 13 mm or more, there can be appropriately secured that portion of the insert portion 19 which is unlikely to bend when the insert portion 19 is pressed into the axial hole 2. Accordingly, the insert portion 19 can sufficiently transmit a pressing force to the resistor composition, so that a resistor having high density can be formed. As a result, a spark plug having excellent under-load life can be provided. When the length F is less than 13 mm, the insert portion 19 fails to sufficiently transmit a pressing force to the resistor composition through bending thereof, so that a resistor having high density is not formed, potentially resulting in a deterioration in under-load life.

In the spark plug 1, the depression formation zone 31 is formed on the entire outer circumferential surface of the slender trunk portion 21 and on a portion of the outer circumferential surface of the trunk portion 22 continuously from the slender trunk portion 21. However, the depression formation zone 31 may be formed on any portion of the outer circumferential surface of the insert portion 19. Preferably, at least a portion of the depression formation zone 31 is disposed in a space surrounded by the stepped portion 15. In the case where the axial hole 2 has the stepped portion 15, if, in the course of the insert portion 19 being pressed into the axial hole 2, the insert portion 19 bends at its portion in the vicinity of the stepped portion 15, the bent portion is caught by the stepped portion 15, resulting in a failure to effectively transmit a pressing force to the resistor composition. Thus, desirably, the depression formation zone 31 is provided on at least that portion of the insert portion 19 which is surrounded by the stepped portion 15; by this practice, the insert portion 19 becomes unlikely to bend at the portion. The depression formation zone 31 is not necessarily provided continuously along a length F of 13 mm or more on the outer circumferential surface of the insert portion 19. For example, the depression formation zone 31 may be provided discontinuously at two positions; specifically, at a portion of the insert portion 19 in the vicinity of the forward end of the insert portion 19 and at a portion of the insert portion 19 surrounded by the stepped portion 15, so long as their total length F is 13 mm or more. If the depression formation zone 31 is provided in the vicinity of the forward end of the insert portion 19, not only does the insert portion 19 becomes unlikely to bend, but adhesion between the insert portion 19 and a seal material is improved.

In the spark plug 1, the depression formation zone 31 assumes the form of twill-line knurling; however, the form of the depression formation zone 31 is not particularly limited. For example, the depression formation zone 31 may assume the form of one of or a combination of lateral-line knurling, slant-line knurling, square thread, triangular thread, and trapezoidal thread. The depression formation zone 31 is such that a plurality of depressions or grooves are formed on an outer circumferential surface of the insert portion 19. However, for example, as viewed on a plane which passes through points located in depressions at half of the depth of the depressions, the depression formation zone 31 can be said to be a depression-protrusion formation zone having a plurality of depressions and protrusions.

Figure 3:
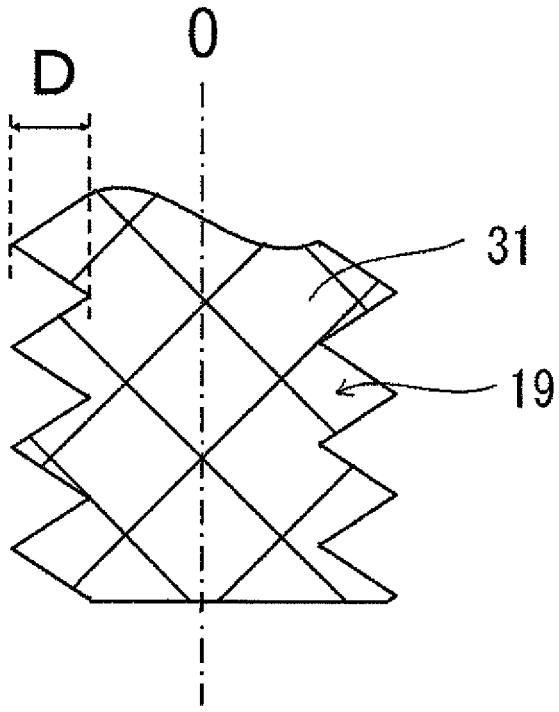
FIG. 3 is a sectional explanatory view showing, on an enlarged scale, a depression formation zone in the spark plug according to the embodiment of the present invention.

In the depression formation zone 31, the depth D of a depression along a direction orthogonal to the axial line O in FIG. 3; i.e., the elevation difference D between a depression and a protrusion adjacent to each other, is preferably 0.07 mm or more, more preferably 0.09 mm to 0.3 mm, most preferably 0.1 mm to 0.2 mm. Through employment of the depth D which falls within the above ranges, the effect of work hardening is likely to be exhibited, so that the insert portion 19 increases in strength at a portion having the depression formation zone 31. Therefore, the insert portion 19 becomes unlikely to bend.

The depth D can be obtained as follows. The insert portion 19 is cut at the depression formation zone 31 along a direction orthogonal to the axial line O. On the obtained cut surface, a maximum diameter and a minimum diameter are measured. A difference between the measured values is divided by 2.

Condition (3): The insert portion 19 has the smooth surface zone 32. In the insert portion 19, a portion having the smooth surface zone 32 is lower in strength than a portion having the depression formation zone 31. Thus, the insert portion 19 becomes likely to bend at the portion having the smooth surface zone 32. In the pressing step to be described later, appropriate bending of the insert portion 19 enables sufficient transmission of a pressing force to the resistor composition. Thus, a resistor having high density can be formed. This is for the following reason. In the pressing step to be described later, after connection powder used to form the first seal layer 27, the resistor 26, and the second seal layer 28 is charged into the axial hole 2, the insert portion 19 is inserted into the axial hole 2, and the metal terminal member 5 is disposed such that the forward end 20 is in contact with the connection powder. At this time, the rear end surface of the insulator 3 and the forward end surface of the terminal portion 18 are separated from each other. Before the insert portion 19 is pressed into the axial hole 2, the distance along the axial line O between the rear end surface of the insulator 3 and the forward end surface of the terminal portion 18 is called a sealing dimension. For example, suppose that a dimension of 10 mm is the maximum sealing dimension which allows the insert portion 19 to be pressed into the axial hole 2 without bending of the insert portion 19 until the terminal portion 18 comes into contact with the rear end surface of the insulator 3. In the case where the insert portion 19 pressed into the axial hole 2 bends appropriately, the maximum sealing dimension increases to such an extent as to correspond to the bending of the insert portion 19 and becomes, for example, 12 mm. As a result of an increase of the sealing dimension of 2 mm, the insert portion 19 can further apply a pressing force to the connection powder. Therefore, the resistor 26 having high density can be formed; as a result, a spark plug having excellent under-load life can be provided.

The smooth surface zone 32 may be provided on any portion of the insert portion 19. Preferably, the smooth surface zone 32 is provided on a portion adjacent to the terminal portion 18; i.e., on a portion surrounded by the second inner circumferential surface 16, along the entire circumference. When the insert portion 19 is pressed into the axial hole 2, if the insert portion 19 bends immediately after it is pressed in, a pressing force may not be effectively transmitted to the resistor composition. However, even though the insert portion 19 bends at its rear side after the insert portion 19 sufficiently applies a pressing force to the resistor composition, no problem arises since a pressing force has already been sufficiently applied to the resistor composition. Rather, as a result of bending of the insert portion 19, the insert portion 19 of the metal terminal member 5 whose terminal portion 18 is slightly separated from the rear end surface of the insulator 3 can be reliably accommodated in the axial hole 2. Also, as a result of bending of the insert portion 19, the insert portion 19 can further apply a pressing force to the resistor composition. Particularly, in the case where the axial hole 2 has the stepped portion 15, the existence of the smooth surface zone 32 on the portion surrounded by the second inner circumferential surface 16 can prevent a bent portion from being caught by the stepped portion 15. Thus, a pressing force can be effectively transmitted to the resistor composition.

Preferably, the smooth surface zone 32 has an axial length (H−F) of 8 mm or more. When the smooth surface zone 32 is 8 mm or more long, at the time of pressing the insert portion 19 into the axial hole 2, that portion of the insert portion 19 which has the smooth surface zone 32 bends appropriately, whereby the insert portion 19 can further apply a pressing force to the resistor composition. In the present embodiment, the smooth surface zone 32 is provided continuously forward from the rear end of the insert portion 19. However, for example, the smooth surface zone 32 may be provided discontinuously at two positions; specifically, at a portion of the insert portion 19 in the vicinity of the rear end of the insert portion 19 and at an axially central portion of the insert portion 19. Alternatively, the smooth surface zone 32 may be provided discontinuously at three or more positions.

Condition (4): The ratio (A/B) between the diameter A of the forward end 20 of the insert portion 19 and the inside diameter B of the insulator 3 measured at the forward end 20 satisfies the relational expression $0.9 \leq A/B \leq 0.98$, preferably $0.93 \leq A/B \leq 0.98$. As a result of the ratio A/B falling within the above ranges, an appropriate clearance is provided between the insert portion 19 and the first inner circumferential surface 14. Accordingly, when the insert portion 19 is pressed into the axial hole 2, the insert portion 19 can effectively transmit a pressing force to the resistor composition. As a result, a spark plug having excellent under-load life can be provided. When the ratio A/B is less than 0.9, the diameter of the insert portion 19 is excessively small in relation to the inside diameter B of the insulator 3. Accordingly, when the insert portion 19 is pressed into the axial hole 2, the insert portion 19 is apt to bend. As a result, the insert portion 19 may fail to effectively transmit a pressing force to the resistor composition. When the ratio A/B is in excess of 0.98, the diameter of the insert portion 19 is excessively large in relation to the inside diameter B of the insulator 3. Accordingly, when the insert portion 19 is pressed into the axial hole 2, a sufficient amount of seal material may not be charged into a clearance between the first inner circumferential surface 14 and the outer circumferential surface of a portion of the insert portion 19 in the vicinity of the forward end of the insert portion 19, since the clearance is small. If a sufficient amount of seal material is not charged into the clearance, under-load life may deteriorate.

As described above, the spark plug 1 which satisfies the above-mentioned conditions (1) to (5) has excellent under-load life for the following reason: when the insert portion is pressed into the axial hole, the insert portion can effectively transmit a pressing force to the resistor composition, whereby a resistor having high density can be formed.

Furthermore, preferably, the difference (J−K) between the diameter K of a portion of the insert portion 19 surrounded by the second inner circumferential surface 16 and the inside diameter J of the second inner circumferential surface 16 measured across the portion has a maximum value $(J-K)_{max}$ of 0.05 mm to 0.25 mm. With the maximum value $(J-K)_{max}$ falling within the above range, when the insert portion 19 is pressed into the axial hole 2, the insert portion 19 becomes likely to appropriately bend at its portion surrounded by the second inner circumferential surface 16. Thus, after the insert portion 19 is pressed into the axial hole 2 and sufficiently transmits a pressing force to the resistor composition, the insert portion 19 bends appropriately at its portion surrounded by the second inner circumferential surface 16, so that there can be prevented the occurrence of a condition in which the terminal portion 18 is not in contact with the rear end surface of the insulator 3 and is separated from the rear end surface. As a result of appropriate bending of the insert portion 19, the insert portion 19 can further applies a pressing force to the resistor composition without involvement of terminal floating, whereby the resistor 26 having high density can be formed. As a result, a spark plug having excellent under-load life can be provided.

Also, in the case where the axial hole 2 has the stepped portion 15, desirably, the second seal layer 28 and/or the resistor 26 exists only in a space surrounded by the first inner circumferential surface 14. That is, desirably, the second seal layer 28 and/or the resistor 26 does not exist rearward of the stepped portion 15 and in the clearance between the metal terminal member 5 and the stepped portion 15 and in the clearance between the metal terminal member 5 and the second inner circumferential surface 16. In the case where the second seal layer 28 and/or the resistor 26 does not exist rearward of the stepped portion 15 and exists only in a space surrounded by the first inner circumferential surface 14, in the pressing step to be described later, this feature restrains conversion of a pressing force, which the metal terminal member 5 applies to the seal powder and/or the resistor composition, to a force to move the seal powder and/or the resistor composition into a clearance between the metal terminal member 5 and the inner wall surface of the insulator 3, so that a pressing force is effectively used for pressing the seal powder and/or the resistor composition. Accordingly, the resistor 26 having high density is formed. Therefore, the present invention can provide a spark plug having excellent under-load life.

In the spark plug 1 of the present invention, employment of an inside diameter B of 3.5 mm or less, particularly 2.9 mm or less yields a higher effect of improving under-load life.

The above-mentioned dimensions A, B, H, F, K, and J can be obtained by measuring corresponding portions on an image of the spark plug which is taken from a direction orthogonal to the axial line O by use of a microradiographic CT system (e.g., TOSCANER-32250 μhd). As shown in FIG. 2, the diameter A is obtained by measuring a distance along a direction orthogonal to the axial line O of that portion of the insert portion 19 which is located 1 mm rearward from the forward end of the insert portion 19. The inside diameter B is obtained by measuring a distance along a direction orthogonal to the axial line O of the axial hole 2 across the above portion of the insert portion 19. The length H is obtained by measuring a length along the axial line O from the rear end to the forward end of the insert portion 19. The length F is obtained by measuring the maximum length along the axial line O of the depression formation zone 31 on the insert portion 19. The diameter K is obtained by measuring a distance along a direction orthogonal to the axial line O of a portion of the insert portion 19 surrounded by the second inner circumferential surface 16. The inside diameter J is obtained by measuring a distance along a direction orthogonal to the axial line O across the portion of the insert portion 19.

The spark plug 1 is manufactured, for example, as follows. First, by publicly known methods, the center electrode 4, the ground electrode 8, the metallic shell 7, the metal terminal member 5, and the insulator 3 are formed into predetermined shapes, respectively (preparation step). The metal terminal member 5 is formed in such a manner as to satisfy at least the above-mentioned conditions (1) to (5). By a publicly known knurling method, the depression formation zone 31 is formed on an outer circumferential surface of a rod portion to be formed into the insert portion 19.

Next, one end portion of the ground electrode 8 is joined to the forward end surface of the metallic shell 7 by, for example, laser welding (ground electrode joining step).

Meanwhile, the center electrode 4 is inserted into the axial hole 2 of the insulator 3, and the flange portion 17 of the center electrode 4 is seated on the second stepped portion 13 of the axial hole 2, thereby disposing the center electrode 4 in such a manner as to be surrounded by the third inner circumferential surface 12 (center electrode disposition step).

Next, seal powder to form the first seal layer 27, a resistor composition to form the resistor 26, and seal powder to form the second seal layer 28 are charged in this order into the axial hole 2 from the rear end of the axial hole 2; then, a press pin is inserted into the axial hole 2 and performs preliminary compression under a pressure of 60 $N/mm^2$ or more for charging the seal powder and the resistor composition into a space surrounded by the first inner circumferential surface (charging step).

Next, the metal terminal member 5 is disposed as follows: the insert portion 19 of the metal terminal member 5 is inserted into the axial hole 2 from the rear end of the axial hole 2 such that the forward end 20 comes into contact with the seal powder (disposition step). At this time, the rear end surface of the insulator 3 and the forward end surface of the terminal portion 18 are separated from each other. In the following description, the distance along the axial line O between the rear end surface of the insulator 3 and the forward end surface of the terminal portion 18 before pressing-in of the insert portion 19 is called a sealing dimension.

Next, while the seal powder and the resistor composition are heated for 3 to 30 minutes at a temperature equal to or higher than the glass softening point of glass powder contained in the seal powder (e.g., at a temperature of 800° C. to 1000° C.), the metal terminal member 5 is pressed until the forward end surface of the terminal portion 18 comes into contact with the rear end surface of the insulator 3, thereby compression-heating the seal powder and the resistor composition (pressing step).

At this time, since the insert portion 19 is formed in such a manner as to satisfy the conditions (1) to (5) mentioned above, the insert portion 19 can effectively apply pressure to the seal powder and the resistor composition in a state in which the insert portion 19 hardly bends toward a direction orthogonal to the axial line O, so that the seal powder and the resistor composition are compressed while being heated. As the seal powder and the resistor composition are compressed, the distance between the rear end surface of the insulator 3 and the forward end surface of the terminal portion 18 reduces. A short while later after start of pressing the insert portion 19 into the axial hole 2, the distance becomes small; at this time, a pressing force is sufficiently transmitted to the resistor composition. Further application of a pressing force causes the insert portion 19 to bend at its portion having the smooth surface zone; i.e., at its portion surrounded by the second inner circumferential surface 16, whereby the forward end surface of the terminal portion 18 comes into contact with the rear end surface of the insulator 3.

Thus, the seal powder and the resistor composition are sintered, whereby the resistor 26, the first seal layer 27, and the second seal layer 28 are formed. At this time, in the spark plug which satisfies the conditions (1) to (5) mentioned above, since a pressing force is sufficiently transmitted to the resistor composition from the metal terminal member 5, the resistor 26 having high density can be formed. Also, there can be prevented the occurrence of a floating condition in which the terminal portion 18 is separated from the rear end surface of the insulator 3. Thus, the spark plug 1 having excellent under-load life is manufactured.

The seal material is charged into the clearance between the flange portion 17 and the wall of the axial hole 2 and the clearance between the slender trunk portion 21 and the wall of the axial hole 2, whereby the center electrode 4 and the metal terminal member 5 are fixed in a sealed condition in the axial hole 2. In the present embodiment, the seal member does not exist rearward of the stepped portion 15.

Next, the insulator 3 to which the center electrode 4, the metal terminal member 5, etc., is assembled to the metallic shell 7 to which the ground electrode 8 is joined (assembling step).

Finally, a distal end portion of the ground electrode 8 is bent toward the center electrode 4 such that one end of the ground electrode 8 faces a forward end portion of the center electrode 4, thereby completing the spark plug 1.

The spark plug according to the present invention is used as an ignition plug for an internal combustion engine of an automobile, such as a gasoline engine, as follows: the threaded portion 9 is threadingly engaged with a threaded hole provided in a head (not shown) which dividingly forms combustion chambers of the internal combustion engine, whereby the spark plug is fixed at a predetermined position. The spark plug according to the present invention can be used in any type of internal combustion engine; however, the spark plug can be preferably used in an internal combustion engine which requires a small-sized spark plug, since the present invention is particularly effective when applied to a small-sized spark plug, particularly to a spark plug whose insulator has an axial hole having a small inside diameter.

The spark plug according to the present invention is not limited to the above-described embodiment, but may be modified in various other forms, so long as the object of the present invention can be achieved. For example, in the spark plug 1, the axial hole 2 has the stepped portion 15; however, that portion of the axial hole 2 which accommodates the insert portion 19 may be formed tubularly with no step formed. Also, in the spark plug 1, the insert portion 19 is composed of the large-diameter trunk portion 22 and the slender trunk portion 21 smaller in diameter than the trunk portion 22; however, the insert portion 19 may further have a portion having a different diameter and may be partially tapered. Also, the insert portion may be uniform in diameter to assume the form of a circular column.

EXAMPLE 1

<Manufacture of spark plugs> Spark plugs shown in FIG. 1 were manufactured according to the manufacturing process described above. The spark plugs differed in the length H of the insert portion, the length F of the depression formation zone, the diameter A of the forward end of the insert portion, the inside diameter B of the insulator measured across the forward end of the insert portion, the inside diameter J of the second inner circumferential surface, the diameter K of a portion of the insert portion surrounded by the second inner circumferential surface, and the depth D of a depression as shown in Tables 1 and 2.

Before manufacture of the spark plugs shown in Tables 1 and 2, the axial distance between the forward end surface of the terminal portion and the rear end surface of the insulator (hereinafter, called the sealing dimension L) measured before the insert portion is pressed into the axial hole in the above-mentioned pressing step was determined as follows. A range of sealing dimension of 10.5 mm to 16.5 mm was divided at 0.5 mm intervals into 12 different sealing dimensions. 20 spark plugs were manufactured for each of the 12 sealing dimensions. A spark plug showing the following phenomenon was taken as a defective spark plug: after the pressing step was conducted, the forward end surface of the terminal portion was separated from the rear end surface of the insulator; i.e., the terminal portion was in a floating condition; or the insulator was broken as a result of application of a pressing force. The sealing dimension L employed in the pressing step in manufacture of a spark plug was 0.5 mm smaller than a sealing dimension with which at least one defective spark plug was formed; i.e., the sealing dimension L was a longest sealing dimension with which a defective spark plug(s) was not formed. Therefore, the spark plugs having various dimensions shown in Table 1 were manufactured with the sealing dimension L which differed among test Nos. Ten spark plugs were manufactured and tested for each test No. Table 1 shows averages.

Various dimensions shown in Table 1 were measured by use of a microradiographic CT system (TOSCANER-32250 μhd). The depth D of a depression was obtained as follows. The insert portion was cut at the depression formation zone along a direction orthogonal to the axial line O. On the obtained cut surface, a maximum diameter and a minimum diameter were measured. The difference between the measured values was divided by 2.

The metal terminal members were formed of low-carbon steel and were varied in Vickers hardness by adjusting its components. The Vickers hardness at room temperature of the insert portions was measured as follows: the insert portions were cut at respective portions having the smooth surface zone in a direction orthogonal to the axial line O, and the Vickers hardness was measured on the resultant cut surfaces near the respective centers according to JTS Z 2244 as mentioned above.

The depression formation zones of test Nos. 1 to 51 and 53 to 67 assumed the form of twill-line knurling formed by knurling work. The depression formation zone of test No. 52 assumed the form of thread formed by threading work.

<Evaluation method> (under-load life test) The manufactured spark plugs were placed in an environment having a temperature of 350° C. and were caused to perform discharge 3,600 times per minute through application of a discharge voltage of 25 kV. The spark plugs were measured for resistance ($R_0$, $R_1$) of resistors before and after the test. The test was conducted 10 times, and there was measured time which elapsed until the average ratio ($R_1/R_0$) of the resistance $R_1$ after test to the initial resistance $R_0$ became 1.5 or higher. Assuming that the longer the time, the better the under-load life, the spark plugs were evaluated under the following criteria. Table 2 shows the results of evaluation. 1: less than 150 hours; 2: 150 hours to less than 200 hours; 3 to 9: point 1 added in 50-hour increments from 200 hours; and 10: 550 hours or more.

TABLE 1

| | Test No. | Dimensions | | | | | | |
|---|---|---|---|---|---|---|---|---|
| | | Insert portion length H (mm) | Depression formation zone length F (mm) | Insulator inside dia. B (mm) | Diameter A (mm) | Ratio (A/B) | Depression depth D (mm) | $(J-K)_{max}$ (mm) |
| Example | 1 | 38.0 | 13 | 3 | 2.80 | 0.93 | 0.15 | 0.20 |
| | 2 | 38.0 | 15 | 3 | 2.80 | 0.93 | 0.15 | 0.20 |
| | 3 | 38.0 | 18 | 3 | 2.80 | 0.93 | 0.15 | 0.20 |
| | 4 | 38.0 | 20 | 3 | 2.80 | 0.93 | 0.15 | 0.20 |
| | 5 | 38.0 | 22 | 3 | 2.80 | 0.93 | 0.15 | 0.20 |
| | 6 | 38.0 | 25 | 3 | 2.80 | 0.93 | 0.15 | 0.20 |
| | 7 | 38.0 | 30 | 3 | 2.80 | 0.93 | 0.15 | 0.20 |
| | 8 | 38.0 | 32 | 3 | 2.80 | 0.93 | 0.15 | 0.20 |
| Comparative example | 9 | 38.0 | 7 | 3 | 2.80 | 0.93 | 0.15 | 0.20 |
| | 10 | 38.0 | 8 | 3 | 2.80 | 0.93 | 0.15 | 0.20 |
| | 11 | 38.0 | 10 | 3 | 2.80 | 0.93 | 0.15 | 0.20 |
| | 12 | 38.0 | 13 | 3 | 2.97 | 0.99 | 0.15 | 0.20 |
| | 13 | 38.0 | 15 | 3 | 2.60 | 0.87 | 0.15 | 0.20 |
| | 14 | 38.0 | 15 | 3 | 2.80 | 0.93 | 0.15 | 0.20 |
| | 15 | 38.0 | 15 | 3 | 2.80 | 0.93 | 0.15 | 0.20 |
| Example | 16 | 38.0 | 15 | 3 | 2.80 | 0.93 | 0.15 | 0.20 |
| | 17 | 38.0 | 15 | 3 | 2.80 | 0.93 | 0.15 | 0.20 |
| | 18 | 38.0 | 15 | 3 | 2.80 | 0.93 | 0.15 | 0.20 |
| | 19 | 38.0 | 15 | 3 | 2.80 | 0.93 | 0.15 | 0.20 |
| | 20 | 38.0 | 15 | 2.7 | 2.50 | 0.93 | 0.15 | 0.20 |
| | 21 | 38.0 | 15 | 2.9 | 2.70 | 0.93 | 0.15 | 0.20 |
| | 22 | 38.0 | 15 | 3.5 | 3.30 | 0.94 | 0.15 | 0.20 |
| | 23 | 38.0 | 15 | 4 | 3.80 | 0.95 | 0.15 | 0.20 |
| Comparative example | 24 | 38.0 | 7 | 2.7 | 2.50 | 0.93 | 0.15 | 0.20 |
| | 25 | 38.0 | 7 | 2.9 | 2.70 | 0.93 | 0.15 | 0.20 |
| | 26 | 38.0 | 7 | 3.5 | 3.30 | 0.94 | 0.15 | 0.20 |
| | 27 | 38.0 | 7 | 4 | 3.80 | 0.95 | 0.15 | 0.20 |
| | 28 | 35.0 | 7 | 3 | 2.80 | 0.93 | 0.15 | 0.20 |
| | 29 | 40.0 | 7 | 3 | 2.80 | 0.93 | 0.15 | 0.20 |
| | 30 | 43.0 | 7 | 3 | 2.80 | 0.93 | 0.15 | 0.20 |
| | 31 | 48.0 | 7 | 3 | 2.80 | 0.93 | 0.15 | 0.20 |
| | 32 | 50.0 | 7 | 3 | 2.80 | 0.93 | 0.15 | 0.20 |
| Example | 33 | 38.0 | 15 | 3 | 2.80 | 0.93 | 0.07 | 0.20 |
| | 34 | 38.0 | 15 | 3 | 2.80 | 0.93 | 0.05 | 0.20 |
| | 35 | 38.0 | 15 | 3 | 2.95 | 0.98 | 0.15 | 0.20 |
| | 36 | 38.0 | 15 | 3 | 2.70 | 0.90 | 0.15 | 0.20 |
| | 37 | 38.0 | 15 | 3 | 2.80 | 0.93 | 0.40 | 0.20 |
| Comparative example | 38 | 38.0 | 15 | 3 | 2.80 | 0.93 | 0.15 | 0.20 |
| | 39 | 38.0 | 15 | 3 | 2.80 | 0.93 | 0.15 | 0.20 |
| | 40 | 38.0 | 15 | 2.7 | 2.50 | 0.93 | 0.15 | 0.20 |
| | 41 | 38.0 | 15 | 2.7 | 2.50 | 0.93 | 0.15 | 0.20 |
| | 42 | 38.0 | 10 | 3 | 2.80 | 0.93 | 0.15 | 0.20 |
| | 43 | 38.0 | 10 | 3 | 2.80 | 0.93 | 0.15 | 0.20 |
| Example | 44 | 43.0 | 15 | 3 | 2.80 | 0.93 | 0.15 | 0.20 |
| | 45 | 43.0 | 15 | 3 | 2.80 | 0.93 | 0.15 | 0.20 |
| | 46 | 43.0 | 15 | 3 | 2.80 | 0.93 | 0.15 | 0.20 |
| | 47 | 38.0 | 15 | 3 | 2.80 | 0.93 | 0.15 | 0.03 |
| | 48 | 38.0 | 15 | 3 | 2.80 | 0.93 | 0.15 | 0.05 |
| | 49 | 38.0 | 15 | 3 | 2.80 | 0.93 | 0.15 | 0.10 |
| | 50 | 38.0 | 15 | 3 | 2.80 | 0.93 | 0.15 | 0.25 |
| | 51 | 38.0 | 15 | 3 | 2.80 | 0.93 | 0.15 | 0.30 |
| | 52 | 38.0 | 15 | 3 | 2.80 | 0.93 | 0.15 | 0.20 |
| | 53 | 38.0 | 7 | 3 | 2.70 | 0.90 | 0.15 | 0.20 |
| | 54 | 38.0 | 7 | 3 | 2.80 | 0.93 | 0.15 | 0.20 |
| | 55 | 38.0 | 7 | 3 | 2.90 | 0.97 | 0.15 | 0.20 |
| | 56 | 38.0 | 15 | 3.5 | 3.30 | 0.94 | 0.15 | 0.20 |
| | 57 | 38.0 | 15 | 3.5 | 3.30 | 0.94 | 0.15 | 0.20 |
| | 58 | 38.0 | 15 | 2.9 | 2.70 | 0.93 | 0.15 | 0.20 |
| | 59 | 38.0 | 15 | 2.9 | 2.70 | 0.93 | 0.15 | 0.20 |
| | 60 | 40.0 | 15 | 2.9 | 2.70 | 0.93 | 0.15 | 0.20 |
| | 61 | 43.0 | 15 | 2.9 | 2.70 | 0.93 | 0.15 | 0.20 |
| | 62 | 50.0 | 15 | 2.9 | 2.70 | 0.93 | 0.15 | 0.20 |
| | 63 | 55.0 | 15 | 2.9 | 2.70 | 0.93 | 0.15 | 0.20 |
| | 64 | 40.0 | 13 | 2.9 | 2.70 | 0.93 | 0.15 | 0.20 |
| | 65 | 43.0 | 13 | 2.9 | 2.70 | 0.93 | 0.15 | 0.20 |
| | 66 | 50.0 | 13 | 2.9 | 2.70 | 0.93 | 0.15 | 0.20 |
| | 67 | 55.0 | 13 | 2.9 | 2.70 | 0.93 | 0.15 | 0.20 |

TABLE 2

| | Test No. | Smooth surface portion presence | Insulator inner stepped portion presence | *1 | *2 | Vickers hardness (Hv) | Depression formation zone form | Evaluation Under-load life |
|---|---|---|---|---|---|---|---|---|
| Example | 1 | Yes | Yes | Yes | No | 220 | Knurling | 10 |
| | 2 | Yes | Yes | Yes | No | 220 | | 10 |
| | 3 | Yes | Yes | Yes | No | 220 | | 10 |
| | 4 | Yes | Yes | Yes | No | 220 | | 10 |
| | 5 | Yes | Yes | Yes | No | 220 | | 10 |
| | 6 | Yes | Yes | Yes | No | 220 | | 10 |
| | 7 | Yes | Yes | Yes | No | 220 | | 10 |
| | 8 | Yes | Yes | Yes | No | 220 | | 8 |
| Comparative example | 9 | Yes | Yes | No | No | 220 | | 1 |
| | 10 | Yes | Yes | No | No | 220 | | 1 |
| | 11 | Yes | Yes | No | No | 220 | | 2 |
| | 12 | Yes | Yes | Yes | No | 220 | | 3 |
| | 13 | Yes | Yes | Yes | No | 220 | | 1 |
| | 14 | Yes | Yes | Yes | No | 120 | | 1 |
| | 15 | Yes | Yes | Yes | No | 380 | | 1 |
| Example | 16 | Yes | Yes | Yes | No | 150 | | 7 |
| | 17 | Yes | Yes | Yes | No | 200 | | 10 |
| | 18 | Yes | Yes | Yes | No | 320 | | 10 |
| | 19 | Yes | Yes | Yes | No | 350 | | 7 |
| | 20 | Yes | Yes | Yes | No | 220 | | 10 |
| | 21 | Yes | Yes | Yes | No | 220 | | 10 |
| | 22 | Yes | Yes | Yes | No | 220 | | 10 |
| | 23 | Yes | Yes | Yes | No | 220 | | 10 |
| Comparative example | 24 | Yes | Yes | No | No | 220 | | 1 |
| | 25 | Yes | Yes | No | No | 220 | | 1 |
| | 26 | Yes | Yes | No | No | 220 | | 2 |
| | 27 | Yes | Yes | No | No | 220 | | 5 |
| | 28 | Yes | Yes | No | No | 220 | | 1 |
| | 29 | Yes | Yes | No | No | 220 | | 1 |
| | 30 | Yes | Yes | No | No | 220 | | 1 |
| | 31 | Yes | Yes | No | No | 220 | | 1 |
| | 32 | Yes | Yes | No | No | 220 | | 1 |
| Example | 33 | Yes | Yes | Yes | No | 220 | | 10 |
| | 34 | Yes | Yes | Yes | No | 220 | | 7 |
| | 35 | Yes | Yes | Yes | No | 220 | | 10 |
| | 36 | Yes | Yes | Yes | No | 220 | | 7 |
| | 37 | Yes | Yes | Yes | No | 220 | | 10 |
| Comparative example | 38 | No | Yes | Yes | No | 220 | | 1 |
| | 39 | No | Yes | Yes | No | 220 | | 1 |
| | 40 | No | Yes | Yes | No | 220 | | 1 |
| | 41 | No | Yes | Yes | No | 220 | | 1 |
| | 42 | Yes | No | — | No | 220 | | 5 |
| | 43 | Yes | No | — | No | 220 | | 5 |
| Example | 44 | Yes | Yes | No | No | 220 | | 6 |
| | 45 | Yes | Yes | No | No | 220 | | 6 |
| | 46 | Yes | Yes | Yes | No | 220 | | 10 |
| | 47 | Yes | Yes | Yes | No | 220 | | 10 |
| | 48 | Yes | Yes | Yes | No | 220 | | 10 |
| | 49 | Yes | Yes | Yes | No | 220 | | 10 |
| | 50 | Yes | Yes | Yes | No | 220 | | 10 |
| | 51 | Yes | Yes | Yes | No | 220 | | 8 |
| | 52 | Yes | Yes | Yes | No | 220 | Thread | 10 |
| | 53 | Yes | Yes | No | No | 220 | Knurling | 1 |
| | 54 | Yes | Yes | No | No | 220 | | 1 |
| | 55 | Yes | Yes | No | No | 220 | | 1 |
| | 56 | Yes | Yes | Yes | No | 220 | | 10 |
| | 57 | Yes | Yes | Yes | Yes | 220 | | 9 |
| | 58 | Yes | Yes | Yes | No | 220 | | 10 |
| | 59 | Yes | Yes | Yes | Yes | 220 | | 8 |
| | 60 | Yes | Yes | Yes | No | 220 | | 10 |
| | 61 | Yes | Yes | Yes | No | 220 | | 10 |
| | 62 | Yes | Yes | Yes | No | 220 | | 10 |
| | 63 | Yes | Yes | Yes | No | 220 | | 10 |
| | 64 | Yes | Yes | Yes | No | 220 | | 10 |
| | 65 | Yes | Yes | Yes | No | 220 | | 9 |
| | 66 | Yes | Yes | Yes | No | 220 | | 8 |
| | 67 | Yes | Yes | Yes | No | 220 | | 8 |

*1 Yes: The depression formation zone is disposed on a portion surrounded by the stepped portion. No: The depression formation zone is not disposed on a portion surrounded by the stepped portion.
*2 Yes: The first seal layer or the resistor exists rearward of the stepped portion No: Neither the first seal layer nor the resistor exists rearward of the stepped portion.

As shown in Tables 1 and 2, the spark plugs which conform to the present invention exhibit excellent under-load life. By contrast, the spark plugs which do not conform to the present invention exhibit poor under-load life.

DESCRIPTION OF REFERENCE NUMERALS

1: spark plug
2: axial hole
3: insulator
4: center electrode
5: metal terminal member
6: connection
7: metallic shell
8: ground electrode
9: threaded portion
10: talc
11: packing
12: third inner circumferential surface
13: second stepped portion
14: first inner circumferential surface
15: stepped portion
16: second inner circumferential surface
17: flange portion
18: terminal portion
19: insert portion
20: forward end
21: slender trunk portion
22: trunk portion
23: first stepped portion
26: resistor
27: first seal layer
28: second seal layer
29, 30: noble metal tip
31: depression formation zone
32: smooth surface zone Having described the invention, the following is claimed:

1. A spark plug comprising:

an insulator having an axial hole extending along an axial line;

a metal terminal member having an insert portion accommodated in the axial hole and a depression formation zone existing on an outer circumferential surface of the insert portion and having a plurality of depressions; and a metallic shell accommodating a forward portion of the insulator therein to thereby hold the insulator, the spark plug being characterized by satisfying the following conditions to:

(1) the insert portion has a length H of 35 mm or more along the axial line;

(2) the depression formation zone has a length F of 13 mm or more along the axial line;

(3) the insert portion has a smooth surface zone on its outer circumferential surface;

(4) a ratio (A/B) between diameter A of a forward end of the insert portion and inside diameter B of the insulator measured at the forward end satisfies a relational expression $0.9 \leq A/B \leq 0.98$; and (5) the insert portion has a Vickers hardness of 150 Hv or more to 350 Hv or less as measured at the center of a cross section of the insert portion cut along a direction orthogonal to the axial line.

2. A spark plug according to claim 1, wherein the insulator has a first inner circumferential surface having the inside diameter B, a second inner circumferential surface having a diameter greater than the inside diameter B and disposed rearward of the first inner circumferential surface and the metallic shell, and a stepped portion connecting the first inner circumferential surface and the second inner circumferential surface, and at least a portion of the depression formation zone is disposed in a space surrounded by the stepped portion.

3. A spark plug according to claim 1, wherein at least a portion of the smooth surface zone is disposed in a space surrounded by the second inner circumferential surface.

4. A spark plug according to claim 1, wherein the depressions in the depression formation zone have a depth D of 0.07 mm or more.

5. A spark plug according to claim 1, wherein the inside diameter B is 3.5 mm or less.

6. A spark plug according to claim 2, wherein a difference (J−K) between diameter K of a portion of the insert portion surrounded by the second inner circumferential surface and inside diameter J of the second inner circumferential surface measured across the portion has a maximum value $(J-K)_{max}$ of 0.05 mm to 0.25 mm.

7. A spark plug according to claim 1, wherein the smooth surface zone has a length (H−F) of 8 mm or more along the axial line.

8. A spark plug according to claim 1, wherein the ratio (A/B) satisfies a relational expression $0.93 \leq A/B$.

9. A spark plug according to claim 1, wherein the inside diameter B is 2.9 mm or less.

10. A spark plug according to claim 1, wherein the Vickers hardness is 200 Hv or more to 320 Hv or less.

11. A spark plug according to claim 2, wherein a connection for electrically connecting the metal terminal member and the center electrode is disposed in the axial hole between the metal terminal member and the center electrode, and the connection exists only in a space surrounded by the first inner circumferential surface.

* * * * *